US008059996B2

(12) United States Patent
Ikeguchi et al.

(10) Patent No.: US 8,059,996 B2
(45) Date of Patent: Nov. 15, 2011

(54) DEVELOPING APPARATUS AND IMAGE FORMING APPARATUS

(75) Inventors: Hiroshi Ikeguchi, Kanagawa (JP); Katsuhiro Aoki, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 197 days.

(21) Appl. No.: 12/481,900

(22) Filed: Jun. 10, 2009

(65) Prior Publication Data

US 2009/0324301 A1 Dec. 31, 2009

(30) Foreign Application Priority Data

Jun. 30, 2008 (JP) ..... 2008-171688

(51) Int. Cl.
*G03G 15/08* (2006.01)

(52) U.S. Cl. ..... 399/281

(58) Field of Classification Search ..... 399/281
See application file for complete search history.

(56) References Cited

U.S. PATENT DOCUMENTS

| | | | | |
|---|---|---|---|---|
| 5,027,157 | A * | 6/1991 | Hotomi et al. | 399/253 |
| 5,339,141 | A | 8/1994 | Suzuki et al. | |
| 5,424,814 | A | 6/1995 | Suzuki et al. | |
| 5,521,690 | A * | 5/1996 | Taffler et al. | 399/93 |
| 5,565,973 | A | 10/1996 | Fujishiro et al. | |
| 5,655,193 | A | 8/1997 | Fujishiro et al. | |
| 6,163,669 | A | 12/2000 | Aoki et al. | |
| 6,295,437 | B1 | 9/2001 | Hodoshima et al. | |
| 6,463,244 | B2 | 10/2002 | Aoki et al. | |
| 6,505,014 | B2 | 1/2003 | Aoki et al. | |
| 6,526,248 | B1 | 2/2003 | Aoki et al. | |
| 6,608,984 | B1 | 8/2003 | Matsumoto et al. | |
| 6,611,672 | B2 | 8/2003 | Aoki et al. | |
| 6,658,227 | B2 | 12/2003 | Oyama et al. | |
| 6,668,147 | B2 | 12/2003 | Ikeguchi | |
| 6,701,114 | B2 | 3/2004 | Sekine et al. | |
| 6,721,516 | B2 | 4/2004 | Aoki et al. | |
| 6,788,913 | B1 | 9/2004 | Aoki et al. | |
| 6,792,234 | B2 | 9/2004 | Ikeguchi et al. | |
| 6,829,463 | B2 * | 12/2004 | Fujii et al. | 399/258 |
| 6,901,233 | B2 | 5/2005 | Aoki et al. | |
| 7,035,575 | B2 | 4/2006 | Ikeguchi et al. | |
| 7,099,611 | B2 | 8/2006 | Aoki et al. | |
| 7,181,155 | B2 | 2/2007 | Aoki et al. | |
| 7,209,685 | B2 | 4/2007 | Oyama et al. | |
| 7,359,661 | B2 | 4/2008 | Aoki et al. | |
| 7,480,475 | B2 | 1/2009 | Miyoshi et al. | |
| 2007/0212121 | A1 | 9/2007 | Takahashi et al. | |
| 2007/0242985 | A1 | 10/2007 | Aoki et al. | |
| 2009/0074431 | A1 | 3/2009 | Aoki et al. | |

FOREIGN PATENT DOCUMENTS

| | | |
|---|---|---|
| JP | 2004-280068 | 10/2004 |
| JP | 2005-221631 | 8/2005 |
| JP | 2006-17965 | 1/2006 |
| JP | 3920845 | 2/2007 |

* cited by examiner

*Primary Examiner* — Constantine Hannaher
(74) *Attorney, Agent, or Firm* — Oblon, Spivak, McClelland, Maier & Neustadt, L.L.P.

(57) ABSTRACT

A developing apparatus performs image visualization processing by electrostatically adhering toner carried on a developer carrying member onto an electrostatic latent image formed on an image carrying member. In the developing apparatus, the toner to be supplied to the developer carrying member is directly injected onto the developer carrying members after flying inside an electric field generated immediately before reaching the developer carrying member. The electric field has one of a homopolarity and a reverse polarity to the electrostatic latent image.

20 Claims, 4 Drawing Sheets

DEVELOPING APPARATUS AND IMAGE FORMING APPARATUS

CROSS-REFERENCE TO RELATED APPLICATIONS

The present application claims priority to and incorporates by reference the entire contents of Japanese priority document 2008-171688 filed in Japan on Jun. 30, 2008.

BACKGROUND OF THE INVENTION

1. Field of the Invention

The present invention relates to a developing apparatus and an image forming apparatus, and more specifically a mechanism for supplying a developer.

2. Description of the Related Art

In typical image forming apparatuses, such as photocopiers, facsimiles, printers, or printing presses, an electrostatic latent image carried on a photosensitive element as a latent-image carrying member is developed with a toner included in a developer through image-visualization processing.

Toner that did not contribute to the image-visualization processing is discarded to a waste container, or returned to a developing apparatus for recycling.

As a developer, a two-component developer that contains a toner and a carrier, and a one-component developer that contains only a toner are known.

A toner to be used in the image-visualization processing needs to be electrically charged so that it electrostatically adheres onto a latent image. To electrically charge the toner, in the case of the two-component developer, there is a method of stirring mixing the two-component developer with a stirring roller. On the other hand, in the case of the one-component developer, there is method of stirring and rubbing the one-component developer while a layer thickness is regulated by a doctor blade for controlling the layer thickness, when toner is carried on the developer carrying member, such as a developing sleeve.

However, if stirring and rubbing are repeated, a mechanical load strongly acts on the toner in the developer, as a result, problems occur as described below.

In the case of a one-component developer, silica or titan, of which particles are to be fluidizing particles, is outwardly added to a toner resin; however, these substances are sometimes stripped or go into hiding inside the toner resin. As a result, fluidity expected to be provided by the fluidizing particles cannot be secured whereby the developer easily sticks on the surface of a member that carries the developer, and causes toner filming that stuck toner is deposited and forms a thin layer, resulting in inferior development due to poor developing bias.

Moreover, mechanical load repeatedly acts on the layer-thickness regulating member against which toner repeatedly collides, thereby causing wear and resulting that accurate regulation of the layer thickness cannot be performed, and bringing about abnormality in an image on a part when deteriorated toner is adhered on the part.

On the other hand, in the case of a two-component developer, the developer adheres to a magnetic carrier, forms a magnetic brush, and repeatedly receives mechanical stress during stirring mixing, thereby resulting in problems that coating on toner particles is stripped and an adverse effect appears on charging performance, and that mechanical stress becomes large due to the use of a magnetic carrier of which mass is larger than the toner, and leads to deterioration in the developer.

As a method of conveying toner without applying mechanical stress to the toner, a method of using air-flow conveyance (for example, see Japanese Patent Publication No. 3920845), and a method of electrostatically conveying toner (for example, see Japanese Patent Application Laid-open No. 2006-17695) are proposed.

Moreover, as a method of electrically charging a toner without applying mechanical stress to the toner, a method of charging via a dielectric process during electrostatic conveyance (for example, see Japanese Patent Application Laid-open No. 2004-280068), and a method of charging by using an electric-field forming unit on the way of a conveying channel for toner (for example, see Japanese Patent Application Laid-open No. 2005-221631) are proposed.

Japanese Patent Publication No. 3920845 discloses a configuration that includes an air-flow conveying unit that includes an outlet in opposition to a magnetic brush to be formed on a developer carrying member is provided, and a charging unit is arranged inside a flow channel of toner used by the air-flow conveying unit.

Japanese Patent Application Laid-open No. 2006-17695 discloses a configuration that includes a bias unit for electrostatically conveying toner inside air bubble that is to be a passage for toner, and charging of toner is performed by using an occasion when toner being electrostatically conveyed contacts with air-bubble inner surface.

Japanese Patent Application Laid-open No. 2004-280068 discloses a configuration that includes an electrostatic conveying unit arranged in a conveying channel of toner to be conveyed toward a developer carrying member, and friction charge of toner is performed when the toner moves while contacting the electrostatic conveying unit.

Japanese Patent Application Laid-open No. 2005-221631 discloses a configuration that includes a one-axis screw pump, and friction charge can be performed when toner moves through a passage inside the screw pump.

One of the above documents discloses a configuration that generates mechanical stress onto a toner, such as stirring mixing, or layer-thickness regulation. Moreover, the toner can be charged on the way of conveyance.

However, according to any of the above configurations, charging of toner is performed during a conveying process of the toner. When such a configuration adapted, charged toner moves while contacting the conveying channel and a conveying member in a conveying process until being delivered to the developer carrying member, so that a fear that outward additive of toner may be stripped is not completely solved.

It is assumed that friction charge is performed while toner is moving through the conveying channel, therefore, a certain length of the conveying channel appropriate to charge is required, and it cannot be expected to reduce the size of the apparatus due to the length of the conveying channel. There is concern that the cost of parts may increase, because a larger electrode is required for electrostatic conveyance for a longer conveying channel. Furthermore, there is concern that a configuration relevant to toner conveyance becomes more complicated, because in order to convey toner electrostatically, a number of electrodes having different polarities need to be arranged in parallel, and bias control is required with respect to each electrode.

SUMMARY OF THE INVENTION

It is an object of the present invention to at least partially solve the problems in the conventional technology.

According to an aspect of the present invention, there is provided a developing apparatus that performs image visualization processing by electrostatically adhering toner carried on a developer carrying member onto an electrostatic latent image formed on an image carrying member. In the developing apparatus, the toner to be supplied to the developer carrying member is directly injected onto the developer carrying members after flying inside an electric field generated immediately before reaching the developer carrying member. The electric field has one of a homopolarity and a reverse polarity to the electrostatic latent image.

According to another aspect of the present invention, there is provided an image forming apparatus that includes the above developing apparatus.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained below in detail with reference to the accompanying drawings.

Figure 1:
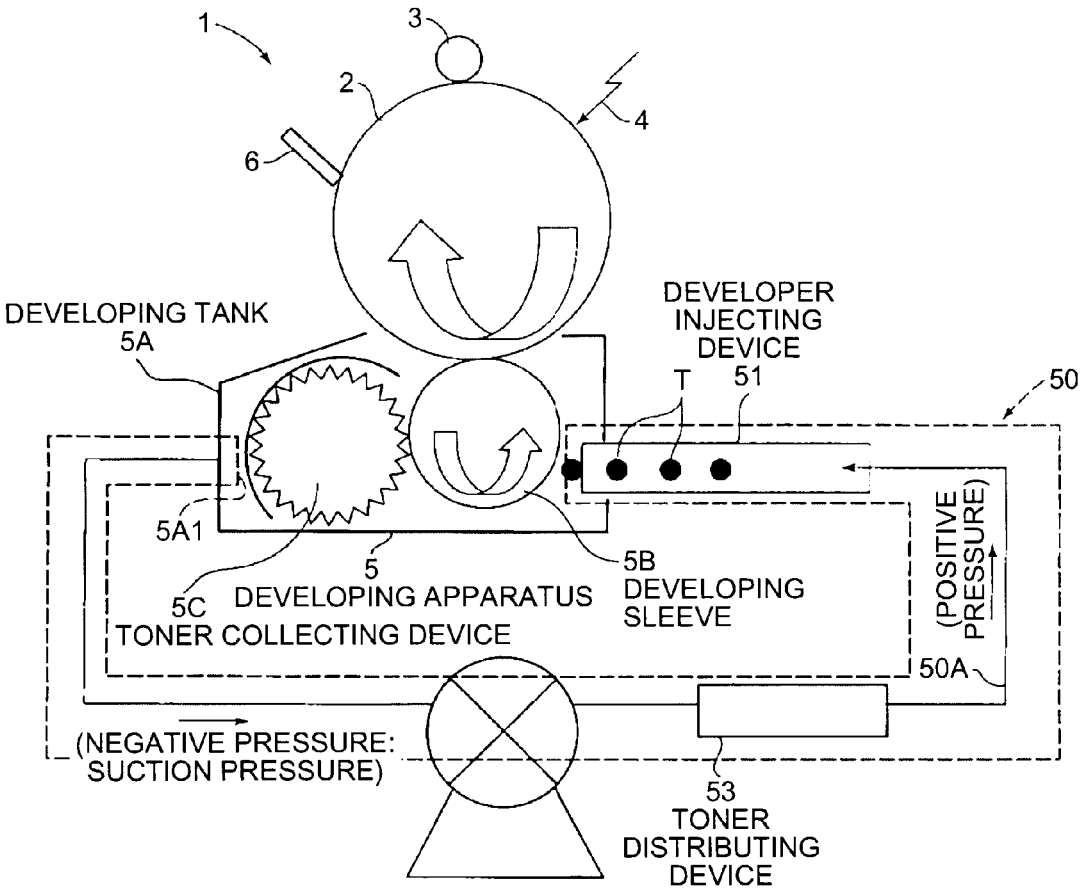
FIG. 1 is a schematic diagram for explaining an image forming apparatus that includes a developing apparatus according to an embodiment of the present invention.

FIG. 1 is a schematic diagram of an image forming apparatus that includes a developing apparatus according to an embodiment of the present invention. Although a toner is explained below as a subject, a developer that includes a carrier can be a subject.

As shown in FIG. 1, an image forming apparatus 1 includes a photosensitive element 2 that is a drum-shaped latent-image carrying member, and a charging device 3, a writing device 4 (of which only a light path is shown in the figure), a developing apparatus 5, and a cleaning device 6, which execute image forming processing, are arranged around the photosensitive element 2 along the rotating direction of the photosensitive element 2. In addition, a transfer device that transfers onto recording paper a toner image on the photosensitive element that has passed through the developing apparatus 5, and a fixing device that fixes the transferred toner image are provided, although they are not shown in the figure.

As shown in FIG. 1, the developing apparatus 5 includes a developing sleeve 5B that functions as a developer carrying member and that is located opposite to the photosensitive element 2 in a developing tank 5A; a toner collecting device 5C that uses a brush roller that collects toner from the surface of the developing sleeve 5B after development processing; and an air-flow conveying unit 50 that injects toner to the developing sleeve 5B.

The air-flow conveying unit 50 includes a developer injecting device 51 that includes an injection nozzle facing to the developing sleeve 5B as a developer carrying member; and a pipe 50A including an end of its extending direction at which the injection nozzle is positioned, and the other end of the extending direction that is connected to a toner collecting unit 5A1 that collects toner from the developing sleeve 5B in the developing tank 5A. An air pump 52 and a toner distributing device 53 are arranged in the pipe 50A. The toner distributing device 53 in this case sometimes uses a toner supply tank.

The air pump 52 has a function of providing a positive pressure in a zone extending to the injection nozzle of the developer injecting device 51 from the arrangement position of the air pump 52, and a negative pressure in a zone extending to the toner collecting unit 5A1 from the arrangement position of the air pump 52, thereby circulating toner within the pipe 50A in which the toner distributing device 53 is arranged on the way.

Figure 2:
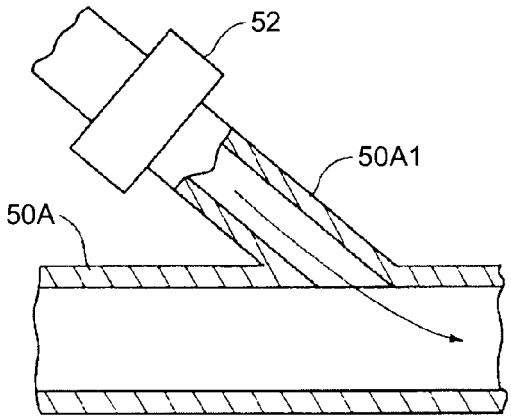
FIG. 2 is a partial cross-sectional diagram of a part of an air-flow conveying unit used in the developing apparatus shown in FIG. 1.

The air pump 52 is, for example, as shown in FIG. 2, installed on an air-flow generating pipe 50A1 connected to the pipe 50A, and blows ambient air into the pipe 50A. Accordingly, in contrast to a case where the air pump 52 is arranged inside the pipe 50A, it is possible to prevent toner from colliding with the components of the air pump 52, thereby not putting mechanical stress on toner.

The developer injecting device 51 has a function of injecting toner toward the developing sleeve 5B as a developer carrying member. An exemplary configuration of the developer injecting device 51 is shown in FIG. 3.

Figure 3:
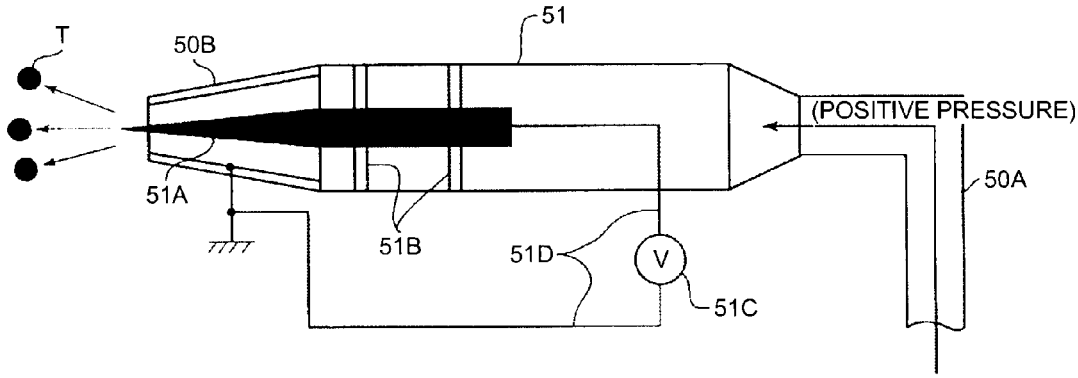
FIG. 3 is a schematic diagram for explaining a developer injecting device that can be used in the developing apparatus shown in FIG. 1.

As shown in FIG. 3, the developer injecting device 51 includes a nozzle structure of which a tip end facing to the developing sleeve 5B is narrowed (hereinafter, "a nozzle unit 50B"), and inside which an electrode needle 51A for generating an electric field is provided.

A shape of the nozzle tip can be a flat shape or an ellipse shape that longitudinally extends in parallel with the axial direction of the developing sleeve 5B corresponding to the longitudinal direction of the developing sleeve 5B.

If the nozzle tip is in another shape, for example, a circle, it is desired to provide the nozzle unit 50B on each of a plurality of positions in parallel along the axial direction of the developing sleeve 5B. Accordingly, toner injected by the developing sleeve 5B can be uniformly supplied in the axial direction of the developing sleeve 5B.

The electrode needle 51A is provided on a position corresponding to a point immediately before flying of toner having being carried through the pipe 50A toward the developing sleeve 5B so that the toner flies within the electric field and then reaches the developing sleeve 5B.

The electrode needle 51A is supported against the inner surface of the pipe 50A via insulations 51B, and connected to a power supply line 51D from a bias power source 51C.

Wiring of the power supply line 51D is configured such that the tail end of the electrode needle 51A is a supply side of the power supply line 51D on which the bias power source 51C is arranged, while the tip end of the nozzle unit 50B of the pipe 50A is a ground side of the power supply line 51D. Accordingly, the electrode needle 51A and the inner surface of the tip end of the nozzle unit 50B form counter electrodes, so that an electric field is formed by a corona discharge occurring between the electrodes at the position corresponding to the point immediately before flying of toner toward the developing sleeve 5B.

The bias power source 51C is configured to apply a bias voltage of a polarity appropriate to an electrostatic property of toner. According to the embodiment, the bias power source 51C is set with a bias voltage from which obtained is a charge amount of toner with the negative polarity under a standard environment (23° C., 50% relative humidity), that is, from −5 μC/g to −50 μC/g, more preferably, from −10 μC/g to −30 μC/g.

The polarity of a bias voltage supplied from the bias power source used for forming an electric field is not limited to a reverse polarity as described above, and can be any polarity depending on details of developing processes. For example, the polarity can be a homopolarity, not limited to a reverse polarity, in accordance with formation of a positive-positive image or formation of a negative-positive image, and in accordance with an electrostatic property of toner by considering relation to a material used as the photosensitive element.

Characteristics of part of members are explained below.

A developing method according to the embodiment is contact development that uses a one-component developer. The photosensitive element 2 includes a drum as a rigid body made of an aluminum pipe of 30 millimeters in diameter as a base. The developing sleeve 5B is an elastic body with a hardness of 10° to 70° (JIS-A), of which diameter is 10 millimeters to 30 millimeters.

A gap is set between the electrode needle 51A and the internal surface of the nozzle unit 50B opposed to the electrode needle 51A, and the width of this gap is set to 2.5 millimeters or less. If the gap is made larger than this, a voltage required for a discharge from the electrode needle 51A exceeds 100 kilovolt, which is disadvantageous in terms of power consumption; and it is intended to avoid a possibility of any electrical discharge to be induced other than between the nozzle unit 50B and the electrode needle 51A.

Although depending on a mass of a developer to be conveyed, a pressure to be generated by the air pump 52 is set to approximately 0.1 megapascals to 0.7 megapascals, so that toner can be injected together with air, and toner can be collected.

In this configuration, when the air pump 52 is activated, an air flow is generated inside the pipe 50A, and toner distributed by the toner distributing device 53 reaches the nozzle unit 50B of the pipe 50A. Naturally, when the air pump 52 is activated, a suction pressure (negative pressure) is generated from the toner collecting unit 5A1 in the developing tank 5A, and the toner is conveyed toward the toner distributing device 53.

The toner that has reached the nozzle unit 50B flies inside an electric field generated with a corona discharge by the electrode needle 51A immediately before flying toward the developing sleeve 5B, and is then injected onto the developing sleeve 5B. When flying, the toner is set to a predetermined charge amount through charge injection. Furthermore, a tip-end electrical discharge by the electrode needle 51A suppresses a loss in the charge amount of the toner that has reached the developing sleeve 5B, and maintains a uniform charge amount.

On the other hand, when toner injected onto the developing sleeve 5B forms a layer on the developing sleeve 5B, an electric potential of the toner in the layer is neutralized with a developing bias on the side of the developing sleeve 5B, and becomes to adhere onto the developing sleeve 5B no more than the thickness of the layer.

As toner not adhered onto the developing sleeve 5B is collected, a toner layer of which thickness is evened is carried on the developing sleeve 5B.

Collection of toner from the developing sleeve 5B can be efficiently performed by collecting toner under a state where a bias is applied to a brush of the toner collecting device 5C.

Another embodiment of a developing apparatus according to the present invention is explained below with reference to FIG. 4.

Figure 4:
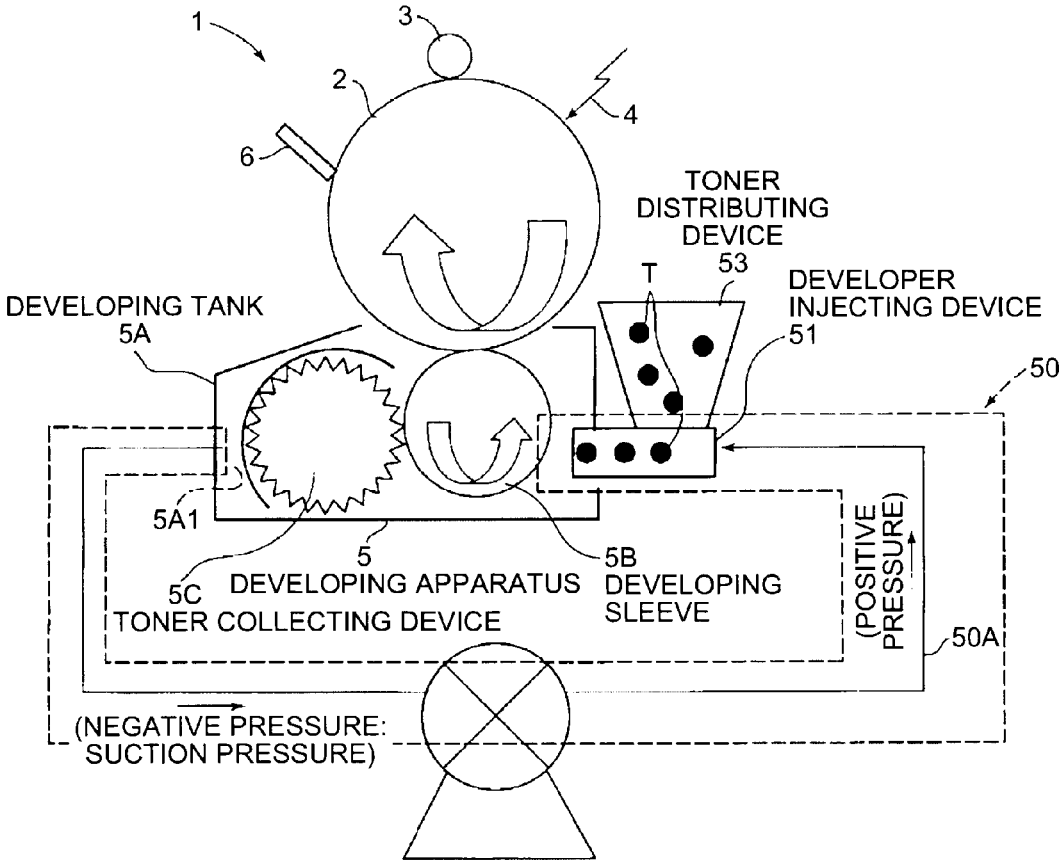
FIG. 4 is a schematic diagram for explaining another embodiment of a developing apparatus used in the image forming apparatus shown in FIG. 1.

In the developing apparatus according to this embodiment, as shown in FIG. 4, the toner distributing device 53 is arranged in front of the position at which toner is injected onto the developing sleeve 5B in the configuration shown in FIG. 1.

Figure 5:
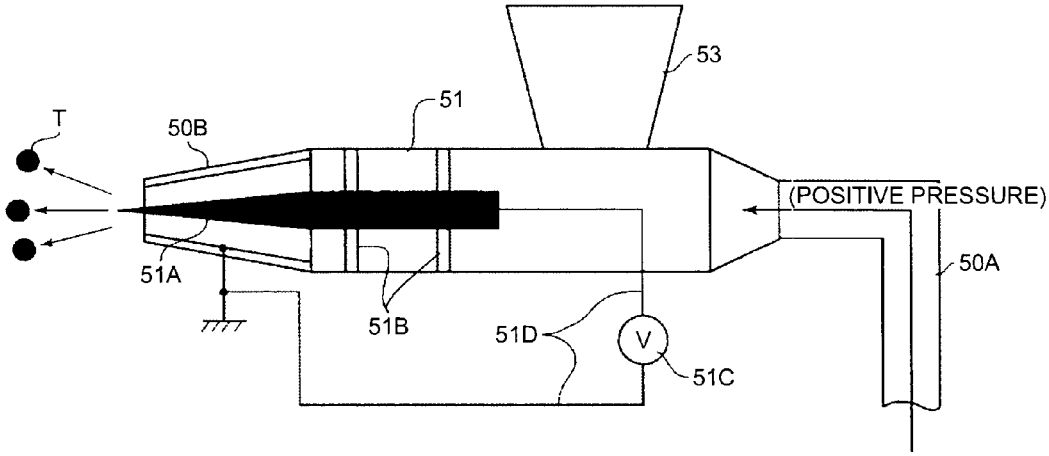
FIG. 5 is a schematic diagram for explaining a developer injecting device that can be used in the developing apparatus shown in FIG. 4.

In the developer injecting device 51 according to this embodiment, as shown in FIG. 5, the toner distributing device 53 is connected to the developer injecting device 51, and the electrode needle 51A is arranged inside the developer injecting device 51 similarly to the case shown in FIG. 1.

With this configuration, toner supplied from the toner distributing device 53 inside the nozzle unit 50B is distributed by an air flow, so that a distance for which the toner is conveyed through the pipe 50A can be reduced, consequently, a mechanical stress on toner caused by, such as contact with the pipe, can be reduced.

The nozzle unit 50B installed on the developer injecting device 51 is able to change the injection direction with respect to the axial direction and the circumferential direction of the developing sleeve 5B, in addition to the configuration described above that the shape and the number of units can be set so as to perform an uniform injection in the axial direction of the developing sleeve 5B. In other words, in order to form a toner layer uniform onto the developing sleeve 5B, not only the axial direction but also the circumferential direction of the developing sleeve 5B is a subject to be considered. For this reason, the nozzle unit 50B can be configured capable to swing along the circumferential direction of the developing sleeve 5B with a not-shown driving device.

By changing an injection angle of the nozzle unit 50B in this way, even if the nozzle unit 50B is brought to closer to the developing sleeve 5B, a uniform toner layer can be formed.

Accordingly, even if the injection nozzle of the developer injecting device 51 is brought closer to the developing sleeve 5B, a uniform toner layer can be formed on the developing sleeve 5B, consequently, even when the developer injecting device 51 is installed, upsizing of the developing apparatus 5 can be avoided.

Figure 6:
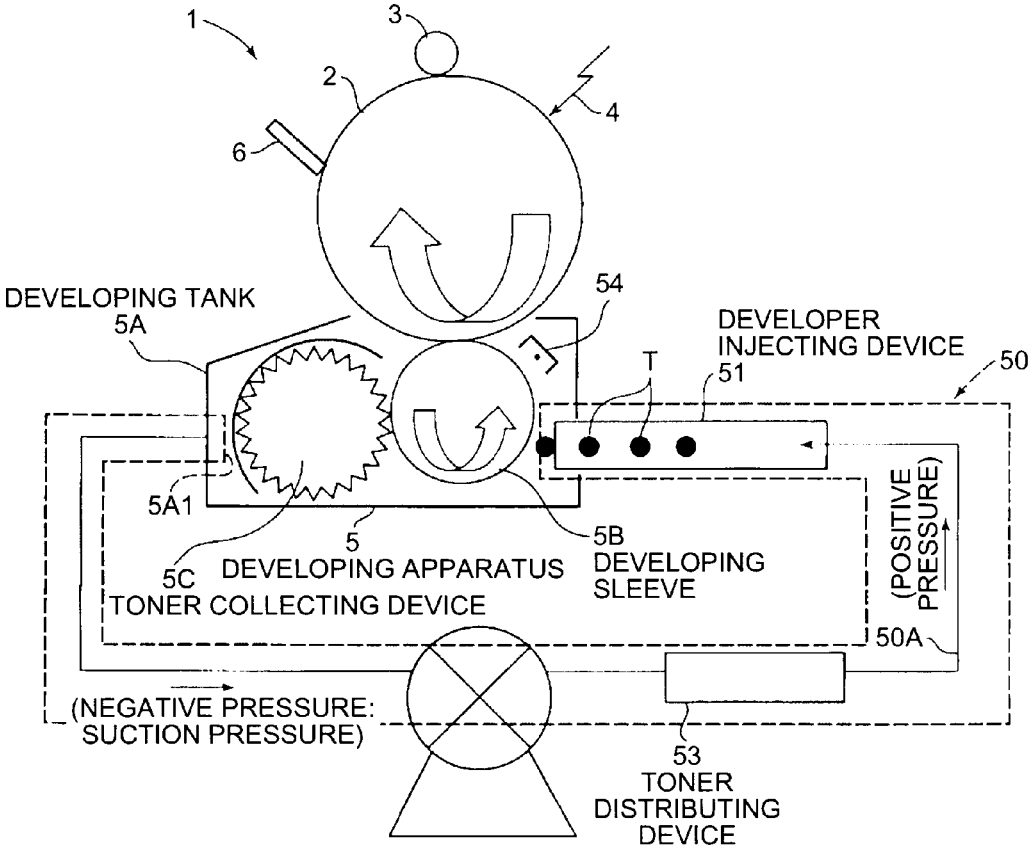
FIG. 6 is a schematic diagram for explaining still another embodiment of a developing apparatus that can be used in the image forming apparatus shown in FIG. 1.

FIG. 6 is a schematic diagram for explaining still another embodiment of a developing apparatus that can be used in the image forming apparatus shown in FIG. 1. Instead of the electrode needle shown in FIG. 1, in the configuration shown in FIG. 6, a charging device is provided in opposition to toner injected from the nozzle unit 50B of the developer injecting device 51 (see FIGS. 3 and 5) or toner carried on the developing sleeve 5B.

As shown in FIG. 6, a charging device 54 is arranged facing to toner that is to fly toward the developing sleeve 5B or in opposition to the developing sleeve 5B, in the vicinity of the injection orifice of the nozzle unit of the developer injecting device 51. The charging device 54 uses a non-contact charging method, such as a corotron method or a scorotron method. Because toner carried on the developing sleeve 5B has been already charged, if it can be considered that the toner is unlikely to be transferred inversely, the toner can be charged by bringing into contact a charging roller for the developing sleeve 5B. Accordingly, the charge amount of toner carried on the developing sleeve 5B can be stabilized.

In this way, when performing charge injection on toner via electric field formation with an electrical discharge, contact with an electrode plate is not needed differently from charge by dielectric. There is a possibility of electrostatic adhesion between charge of toner and charge on the side of the developing sleeve 5B with respect to an area in which a layer thickness of the toner is changed by being consumed by the developing sleeve 5B, therefore, when replenishing toner, it can be configured not to increase a volume of toner replenishment more than required.

As a configuration for charging toner, it is possible to give frictional contact to toner flowing through the pipe 50A in the air-flow conveying unit 50.

Figure 7:
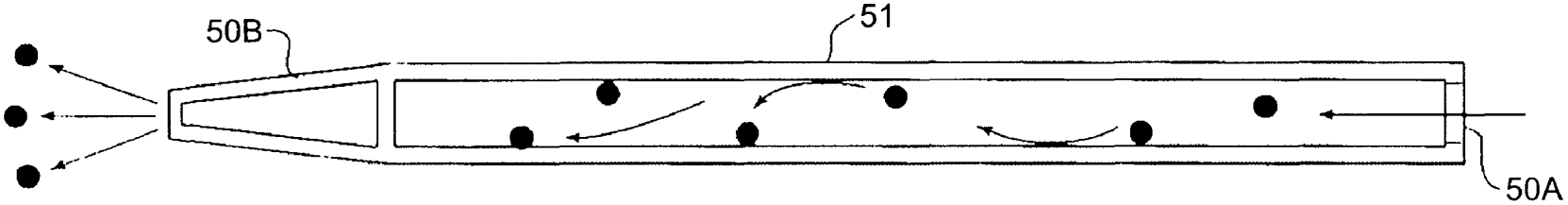
FIG. 7 is a schematic diagram for explaining a method of changing a toner employed in the developing apparatus shown in FIG. 1.

FIG. 7 depicts a configuration in such case.

As shown in FIG. 7, by generating a turbulent flow, such as a swirl flow, in addition to a laminar flow as an air flow to be generated inside the pipe by the air pump 52, toner moving inside the pipe 50A becomes more easily to contact with the pipe inner surface and toner each other, and then the toner is charged through friction caused by the contact. As a method of generating a swirl flow, when using the configuration shown in FIG. 2, there is a method that an air flow is guided in a spiral by providing spiral static vane on a forward side of the air-flow direction of the air pump 52 inside the air-flow generating pipe 50A1, or a method that a connecting position between the air-flow generating pipe 50A1 and the pipe 50A is set to a position decentered from the center to the pipe. Even if an air flow from the air pump is a laminar flow, variations in the air-flow velocities between the pipe inner-surface side and the pipe center side due to friction with the pipe inner surface can be used for a turbulent flow.

According to the configuration of the developer injecting device 51 in this case, toner is charged while being conveyed with air flow, the electrode needle 51A that performs a corona discharge for charging toner can be omitted.

There is concern that a pressure may increase inside the developing tank 5A in which the developing sleeve 5B is arranged depending on pressure setting of the air pump of the air-flow conveying unit 50. In such case, it is effective to form a negative pressure inside the developing tank 5A by providing a depressurizing structure in the developing tank 5A.

Although the above explanations are described about the developing sleeve that is a cylinder in shape as a developer carrying member, the embodiments are not limited to this, and the developer carrying member can be a belt in shape.

Moreover, although the developing apparatus according to the embodiments of the present invention is described about a case of using a one-component developer in a non-contact developing method, the embodiments are not limited to this, and various known methods of a contact developing method or a non-contact developing method can be used. For example, a contact developing method that uses an aluminum sleeve, a contact developing method that uses a conductive rubber belt, or a non-contact developing method that uses a developer carrying member that a conductive resin layer including carbon black, metal filler, or the like is formed on the surface of an aluminum pipe can be used.

Characteristics of the developer carrying member and the toner used in the embodiment are listed below.

A surface coating material of the toner carrying member can be a material that contains a resin or a rubber, such as silicon, acryl, or polyurethane. Moreover, a material that contains fluorine can be used as another material. A so-called Teflon (registered trademark) base material that contains fluorine has low surface energy, and is effective in terms of releasability, consequently, toner filming over time is unlikely to occur. To name examples of common resin materials that can be used as the surface coating material: polytetrafluoroethylene (PTFE), tetrafluoroethylene-perfluoroalkylvinyl ether (PFA), tetrafluoroethylene-hexafluoropropylene polymer (FEP), polychlorotrifluoroethylene (PCTFE), ethylene-tetrafluoroethylene copolymer (ETFE), ethylene-chlorotrifluoroethylene copolymer (ECTFE), polyvinylidene fluoride (PVDF), polyvinyl fluoride (PVF), and the like. To obtain conductivity for the surface coating material, a conductive material, such as carbon black, is often contained as required. Moreover, it is possible to reduce resistance by mixing a conductive polymeric resin, such as polyacetylene or polythiophen, on which doping is performed. Sometimes another resin is mixed in some cases in order to coat the toner carrying member more uniformly. About electric resistance, volume resistivity in bulk is to be set by including the coating layer, and coordinated with the resistance of a base layer so as to be set between $10^3$ Ω·cm and $10^8$Ω·cm. The volume resistivity of the base layer used in the embodiment is between $10^3$Ω·cm and $10^5$Ω·cm, therefore, the volume resistivity of the surface layer is sometimes set slightly higher.

Because the developing apparatus and the image forming apparatus according to the embodiment use the photosensitive element of a rigid drum made of an aluminum pipe as a base, a developing roller made from a rubber material that is elastic is suitable as the toner carrying member, and the hardness in a range from 10° to 70° (JIS-A) is suitable. The diameter of the toner carrying member is preferably between 10 millimeters and 30 millimeters. According to the embodiment, a toner carrying member of 16 millimeters in diameter is used. The surface of the toner carrying member is appropriately roughened to have a roughness Rz (ten point height of irregularities) between 0.1 μm and 4 μm. To name examples of rubber materials acceptable to be used for the developing roller: silicon, butadiene, nitrile-butadiene rubber (NBR), hydrin, ethylene propylen dien monomer (EPDM), urethane rubber, and the like.

Moreover, in order to reduce the hardness, for example, an endless belt using a metal sheet can be used as a toner carrying member for performing contact development.

Toner to be used for the development method needs to have an average particle diameter of the toner between 3 μm and 8 μm in order to achieve a high quality image. A weight average particle diameter of the toner is between 4 μm and 7 m, and more preferably between 4 μm and 6 μm. If the weight average particle diameter is less than 4 μm, a problem tends to arise, such as contamination inside the apparatus caused by airborne toner particles through a long-term use, degradation in image density under a low humidity environment, or imperfect cleaning of the photosensitive element, and moreover there is a fear of an influence on a human body. If the weight average particle diameter is more than 8 μm, the resolution for a very small spot of 100 μm or less is not sufficient, and spatters of toner onto a non-image area are not few, as a result, the image quality tends to be inferior.

Details of the toner are described below.

A resin to be used can be polystyrene resin, epoxy resin, polyester resin, polyamide resin, styrene-acrylic resin, styrene methacrylate resin, polyurethane resin, vinyl resin, polyolefin resin, styrene-butadiene resin, phenolic resin, polyethylene resin, silicone resin, butyral resin, terpene resin, polyol resin, or the like. To name examples of vinyl resin: homopolymers of styrene or its substitution, such as polystyrene, poly-p-chlorostyrene, and polyvinyl toluene; styrene copolymers, such as styrene-p-chlorostyrene copolymer, styrene-propylene copolymer, styrene-vinyl toluen copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, and styrene-ester maleate copolymer; polymethyl methacrylate, polybuthyl methacrylate, polyvinyl chloride, polyvinyl acetate, and the like.

A polyester resin includes dihydric alcohol as shown in a group A below and dibasic acid salt as shown in a group B below, and can be added with trihydric or higher polyhydric alcohol or carboxylic acid as shown in a group C below as a third component.

Group A: ethylene glycol, triethylene glycol, 1,2-propylene glycol, 1,3-propylene glycol, 1,4-butanediol, neopentyl glycol, 1,4-butanediol, 1,4-bis(hydroxy methyl)cyclohexane, bisphenol A, hydrogen-added bisphenol A, polyoxy ethylene bisphenol A, polyoxy propylene (2,2)-2,2'-bis(4-hydroxy phenyl) propane, polyoxy propylene (3,3)-2,2-bis(4-hydroxy phenyl) propane, polyoxy ethylene (2,0)-2,2-bis(4-hydroxy phenyl) propane, polyoxy propylene (2,0)-2,2'-bis(4-hydroxy phenyl) propane, and the like.

Group B: maleic acid, fumaric acid, mesaconic acid, citraconic acid, itaconic acid, glutaconic acid, phthalic acid, isophthalic acid, terephthalic acid, cyclohexane dicarboxylic acid, succinic acid, adipic acid, sebacic acid, malonic acid, linolenic acid, acid anhydrides of the above components, esters of lower alcohol with the above components, and the like.

Group C: trihydric or higher polyhydric alcohols, such as glycerin, trimethyl propane, and pentaerythritol; trivalent or higher polyvalent carboxylic acids, such as trimellitic acid, and pyromellitic acid; and the like. A polyol resin can be, for example, a product produced by reacting an epoxy resin, an alkylene oxide adduct of a dihydric phenol or glycidyl ether of the alkylene oxide adduct, a compound intramolecularly including one active hydrogen atom that can react with an epoxy group, and a compound intramolecularly includes two or more active hydrogen atoms that can react with a epoxy resin.

Examples of a pigment to be used for the toner according to the embodiment are described below.

To name examples of black pigments: azine pigments, such as carbon black, oil furnace black, channel black, lamp black, acetylene black, aniline black; metallic salt azo pigments; metal oxides; and composite metal oxides.

To name examples of yellow pigments: cadmium yellow, mineral fast yellow, nickel yellow, navel yellow, naphthol yellow S, Hanza yellow G, Hanza yellow 10G, benzidine yellow GR, quinoline yellow lake, permanent yellow NCG, and tartrazine lake.

To name examples of orange pigments: molybdenum orange, permanent orange GTR, pyrazolone orange, Vulcan orange, indanthrene brilliant orange RK, benzidine orange G, and indanthrene brilliant orange GK.

To name examples of red pigments: iron oxide red, cadmium red, permanent red 4R, lithol red, pyrazolone red, watching red calcium salt, lake red D, brilliant carmine 6B, eosin lake, rhodamine lake B, alizarin lake, and brilliant carmine 3B.

To name examples of purple pigments: fast violet B, and methyl violet lake.

To name examples of blue pigments: cobalt blue, alkali blue, Victoria blue lake, phthalocyanine blue, nonmetal phthalocyanine blue, phthalocyanine blue partly chloride, fast sky blue, and indanthrene blue BC.

To name examples of green pigments: chromium green, chromium oxide, pigment green B, and malachite green lake.

Each of the above pigments can be used alone or in combination of two or more of them. Particularly, color toners are required to achieve favorable uniform distribution of a pigment, therefore, a method of producing once a master batch in which a pigment is distributed in a high concentration, then loading the master batch into a resin in a manner of diluting the master batch, instead of loading a large volume of pigment directly into the resin. In such case, generally a solvent is used for helping distribution; however, because there is an environmental problem, the toner is distributed by using water according to the embodiments of the present invention. When using water, temperature control is required not to cause a problem of residual water left in the master batch.

The toner used in the embodiments contains (inwardly adds) a charge control agent inside each toner particle. The charge control agent enables optimal charge-amount control appropriate to a development system. Particularly according to the embodiments of the present invention, a balance between the size distribution of particles and a charge amount can be kept more stable. As a charge control agent to control a toner to positive charge, nigrosin, quaternary ammonium salt, triphenylmethane dyes, imidazole metal complexes and salts can be used alone or in combination of two or more of them. As a charge control agent to control a toner to negative charge, metal salicylate complexes and salts, organic boron salts, calixarene compounds, or the like can be used. Moreover, the toner according to the embodiment of the present invention can inwardly adds a release agent to avoid setoff when being fixed. The release agent can be a natural wax, such as candelilla wax, carnauba wax, or rice wax, a montan wax and its derivative, a paraffin wax and its derivative, a polyolefine wax and its derivative, a Sasol wax, low molecular weight polyethylene, low molecular weight polypropylene, alkyl phosphate, or the like. The melting point of the release agent is preferably from 65 to 90° C. When the melting point is lower than the range, blocking at the time of storing toner tends to occur. When the melting point is higher than the range, setoff tends to occur in a region of a low fixing temperature.

An additive can be added in order to improve distribution of releasability, for example. An additive to be used can be styrene-acrylic resin, polyethylene resin, polystyrene resin, epoxy resin, polyester resin, polyamide resin, styrene methacrylate resin, polyurethane resin, vinyl resin, polyolefin resin, styrene-butadiene resin, phenolic resin, butyral resin, terpene resin, polyol resin, or the like; and can be a mixture of two or more resins among them.

Crystalline polyester can be used as a resin. The crystalline polyester is an aliphataic polyester, has crystalinity and a sharp molecular-weight distribution, and its absolute amount of low molecular weight is made as much as possible. The resin goes into crystalization transition at a glass transition temperature (Tg), at the same time, its melting viscosity decreases rapidly from a solid state, and the resin expresses a fixing function onto paper. By using the crystalline polyester resin, low-temperature fixing can be achieved without excessively decreasing Tg and the molecular weight of the resin. Therefore, there is no degradation in preservation caused by decrease in Tg. Moreover, neither too high gloss nor degradation in setoff resistance occurs along with low molecular weight. For this reason, the introduction of the crystalline polyester resin is substantially effective for improvement in fixing property of the toner at a low temperature.

As described above, the toner according to the embodiments of the present invention is adhered or fastened with inorganic fine powder as a fluidity improver onto the surface of each toner particle. An average particle diameter from 10 nanometers to 200 nanometers of the inorganic fine powder is suitable. If the particle diameter is smaller than 10 nanometers, it is difficult to produce an asperate surface effective for fluidity. By contrast, if the particle diameter is larger than 200 nanometers, the particle shape becomes rough, and causes a problem of a toner shape.

To name examples of inorganic fine powder of a toner to be used in the embodiment: an oxide, a hydride, a dioxide, a sulfide, or a composite oxide of Si, Ti, Al, Mg, Ca, Sr, Ba, In, Ga, Ni, Mn, W, Fe, Co, Zn, Cr, Mo, Cu, Ag, V, Zr, or the like. Among them, the following oxides are often used in light of safety and stability.

Particularly, microparticles of silicon dioxide (silica), titanium dioxide (titania), and aluminum oxide (alumina, corundum) are preferably used.

Surface modification processing of an additive with, such as a hydrophobic treatment agent, is effective. A typical example of a hydrophobic treatment agent is a silane-coupling agent, listed as follows:

Dimethyldichlorosilane, trimethylchlorosilane, methyltrichlorosilane, allyldimethyldichlorosilane, allylphenyldichlorosilane, bnezyldimethylchlorosilane, brommethyldimethylchlorosilane, α-chloroethyltrichlorosilane, p-chloroethyltrichlorosilane, chloromethyldimethylchlorosilane, chloromethyltrichlorosilane, hexaphenyldisilazane, and hexatolyldisilazane.

The content of the inorganic fine powder is preferably 0.1% by weight to 2% by weight of the weight of the toner. If the content is less than 0.1% by weight, an effect of preventing toner agglomeration becomes poor, by contrast, if the content is more than 2% by weight, it tends to cause a problem, such as spatters of toner between thin lines, contamination inside the apparatus, or scratch or wear on the photosensitive element.

It can be configured such that a charge control agent is adhered or fastened onto the surface of a powder particle made of at least a resin and a pigment, so that surface configurations of powder particles can have a small cycle and a large cycle. Optimal inorganic fine powder has a small particle diameter from 10 nanometers to 200 nanometers in average. If the particle diameter is smaller than 10 nanometers, it is difficult to produce an asperate surface effective for fluidity. By contrast, if the particle diameter is larger than 200 nanometers, the particle shape becomes rough, and causes a problem of a toner shape.

For the toner according to the embodiments, another additive can be further used as a development enhancement a little within a limit up to which there is no substantial adverse effect: for example, lubricant powder, such as Teflon (registered trademark) powder, zinc stearate powder, or polyvinylidene fluoride powder; an abrasive, such as cerium dioxide powder, silicon carbide powder, or strontium titanate powder; or a conductivity-giving agent, such as carbon black powder, zinc oxide powder, or tin oxide powder.

The evaluation method can be used for a capsule toner or a toner that is produced by, for example, a spray-dry method, without using mixing process or grinding process.

According to the embodiments of the present invention, because toner being conveyed in air flow flies in an electric field that is generated immediately before the toner reaches a developer carrying member, there is no change in the charge amount on the way of the conveyance, differently from a case where toner is charged before reaching the developer carrying member. Accordingly, the charge amount of toner when reaching the developer carrying member can be set to a charge amount required for image-visualization processing of a latent image.

It is configured to generate an electric field with a corona discharge by using an electrode needle of which a tip end faces the developer carrying member, that is charge injection, and not dielectric phenomenon caused by contact with an electrode plate, therefore, a charge amount can be accurately regulated. A tip-end electric discharge can be performed by the electrode needle, thereby avoiding loss in the charge amount of toner adhered on the developer carrying member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing apparatus, comprising:

a developer carrying member;

an image carrying member disposed adjacent to the developer carrying member; and an air-flow conveying unit that conveys the toner with an air pressure to fly the toner, wherein the air-flow conveying unit includes a pipe, one end of an extending direction of the pipe provided with an injection nozzle that injects toner toward the developer carrying member, and a toner collecting unit that collects toner from the developer carrying member provided at another one of the ends, wherein the developing apparatus performs image visualization processing by electrostatically adhering toner carried on the developer carrying member onto an electrostatic latent image formed on the image carrying member, and wherein the toner supplied to the developer carrying member is directly injected onto the developer carrying member after flying inside an electric field generated in the air-flow conveying unit immediately before reaching the developer carrying member, the electric field having one of a homopolarity and a reverse polarity to the electrostatic latent image.

2. The developing apparatus according to claim 1, further comprising:

an air pump that is arranged inside the pipe, and circulates air in the pipe; and a distribution device that distributes toner that is conveyed with a positive pressure generated by the air pump.

3. The developing apparatus according to claim 2, wherein the pipe used in the air-flow conveying unit has a negative pressure on a side of the toner collecting unit with respect to a border at a position of the air pump.

4. The developing apparatus according to claim 2, wherein the positive pressure generated by the air pump is approximately 0.1 megapascals to 0.7 megapascals.

5. The developing apparatus according to claim 1, wherein the injection nozzle in the pipe is provided with a developer injecting device that includes an electrode needle in an inside of the nozzle to generate the electric field.

6. The developing apparatus according to claim 5, wherein a longitudinal direction of the electrode needle is in parallel with a flying direction of the toner, and a tip end of the electrode needle faces the developer carrying member.

7. The developing apparatus according to claim 5, wherein the electrode needle generates a corona discharge of one of a homopolarity and a reverse polarity to a polarity of an electrostatic latent image on the developer carrying member.

8. The developing apparatus according to claim 5, wherein the electrode needle is supported against an inner surface of the pipe via insulations.

9. The developing apparatus according to claim 5, wherein a gap between the electrode needle and an internal surface of the nozzle is at most 2.5mm.

10. The developing apparatus according to claim 1, wherein the air-flow conveying unit has a first end in an extending direction arranged in opposition to the developer carrying member, and a second end in the extending direction arranged at a position configured to collect toner of which injection to the developer carrying member is finished.

11. The developing apparatus according to claim 1, wherein a plurality of the injection nozzles are arranged in parallel along a longitudinal direction of the developer carrying member.

12. The developing apparatus according to claim 1, wherein the air-flow conveying unit fixes an air flow inside the pipe to one of a laminar flow and a turbulent flow that includes a swirl flow.

13. The developing apparatus according to claim 1, wherein the polarity is a reverse polarity between −10 μC/g to −30 μC/g.

14. The developing apparatus according to claim 1, wherein the developing apparatus uses one-component developer in a non-contact developing structure.

15. An image forming apparatus, comprising:

a developing apparatus including:

a developer carrying member;

an image carrying member disposed adjacent to the developer carrying member; and an air-flow conveying unit that conveys the toner with an air pressure to fly the toner, wherein the air-flow conveying unit includes a pipe, one end of an extending direction of the pipe provided with an injection nozzle that injects toner toward the developer carrying member, and a toner collecting unit that collects toner from the developer carrying member provided at another one of the ends, wherein the developing apparatus performs image visualization processing by electrostatically adhering toner carried on the developer carrying member onto an electrostatic latent image formed on the image carrying member, and wherein the toner supplied to the developer carrying member is directly injected onto the developer carrying member after flying inside an electric field generated in the air-flow conveying unit immediately before reaching the developer carrying member, the electric field having one of a homopolarity and a reverse polarity to the electrostatic latent image.

16. The image forming apparatus according to claim 15, wherein the developing apparatus uses one-component developer in a non-contact developing structure.

17. The image forming apparatus according to claim 15, wherein the toner has an average particle diameter of between 3 and 8 micrometers.

18. The image forming apparatus according to claim 17, wherein the toner includes a charge control agent in an inside thereof.

19. The image forming apparatus according to claim 17, wherein the toner includes inorganic fine powder with 0.1% by weight to 2% by weight of the weight of the toner.

20. The image forming apparatus according to claim 17, wherein the toner includes an additive added to the toner.

* * * * *